US008690416B2

(12) United States Patent
Jung

(10) Patent No.: US 8,690,416 B2
(45) Date of Patent: Apr. 8, 2014

(54) DISPLAY DEVICE

(75) Inventor: Ji Young Jung, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 245 days.

(21) Appl. No.: 13/248,345

(22) Filed: Sep. 29, 2011

(65) Prior Publication Data

US 2012/0127752 A1 May 24, 2012

(30) Foreign Application Priority Data

Nov. 23, 2010 (KR) ..... 10-2010-0117170

(51) Int. Cl.
*F21V 7/04* (2006.01)

(52) U.S. Cl.
USPC ..... 362/622; 362/601; 362/621; 362/231; 362/84

(58) Field of Classification Search
USPC ..... 362/601, 84, 231, 621, 622
See application file for complete search history.

(56) References Cited

U.S. PATENT DOCUMENTS

| | | | | |
|---|---|---|---|---|
| 6,536,914 | B2 * | 3/2003 | Hoelen et al. | 362/231 |
| 6,637,905 | B1 * | 10/2003 | Ng et al. | 362/601 |
| 7,661,841 | B2 * | 2/2010 | Kurihara et al. | 362/231 |
| 7,887,206 | B2 * | 2/2011 | Lee | 362/84 |
| 7,934,862 | B2 * | 5/2011 | Anandan | 362/606 |
| 2003/0067008 | A1 * | 4/2003 | Srivastava et al. | 257/79 |
| 2004/0100788 | A1 * | 5/2004 | Ju | 362/31 |
| 2004/0141700 | A1 * | 7/2004 | Yang | 385/120 |
| 2006/0002141 | A1 * | 1/2006 | Ouderkirk et al. | 362/609 |
| 2006/0002152 | A1 | 1/2006 | Lee et al. | |
| 2010/0002466 | A1 | 1/2010 | Kim et al. | |
| 2011/0240960 | A1 | 10/2011 | Kim et al. | |

FOREIGN PATENT DOCUMENTS

| | | | |
|---|---|---|---|
| JP | 9-73807 | A | 3/1997 |
| JP | 2004-273185 | A | 9/2004 |
| JP | 2010-61098 | A | 3/2010 |
| KR | 10-2006-0001252 | A | 1/2006 |
| KR | 10-2010-0004398 | A | 1/2010 |

OTHER PUBLICATIONS

Office Action dated Apr. 24, 2012 in Korean Application No. 10-2010-0117170, filed Nov. 23, 2010.

* cited by examiner

*Primary Examiner* — Ali Alavi
(74) *Attorney, Agent, or Firm* — Saliwanchik, Lloyd & Eisenschenk

(57) ABSTRACT

Provided are an optical member and a display device. The display device includes a light source, a plurality of wavelength converting particles, an approximately, and a display panel. The wavelength converting particles convert a wavelength of light emitted from the light source. The accommodating part accommodates the wavelength converting particles and has a curved surface. The display panel is configured to display images using light changed by the wavelength converting particles.

6 Claims, 10 Drawing Sheets

DISPLAY DEVICE

CROSS-REFERENCE TO RELATED APPLICATION

This application claims the benefit under 35 U.S.C. §119 of Korean Patent Application No. 10-2010-0117170, filed Nov. 23, 2010, which is hereby incorporated by reference in its entirety.

BACKGROUND

The present disclosure relates to a display device.

Light emitting diodes (LEDs) are semiconductor devices used in apparatuses such as home appliances, remote controllers, and large electronic boards for converting electricity into light such as ultraviolet rays, visible rays, and infrared rays.

LED light sources emitting very bright light are used for illumination devices or the like because LED light sources have good energy efficiency and require low maintenance costs owing to long lifespan. In addition, since LED light sources are durable to vibrations and impacts and do not include toxic materials such as mercury, existing incandescent lamps and fluorescent lamps are being replaced with LED light sources for the purposes of energy saving, environment protection, and cost reduction.

Furthermore, LEDs are used as light sources of liquid crystal display (LCD) TVs and monitors. Since LEDs have merits such as good color saturation, low power consumption, and small size as compared with current cold cathode fluorescent lamps (CCFLs) used as light sources of LCDs, more LCD products use LEDs as light sources, and much research is being conducted on LEDs.

Recently, many techniques have been proposed to produce white light using a blue LED and a quantum dot (QD) structure as a fluorescent substance producing red light and green light. White light produced by using a quantum dot structure is very bright and has good color reproduction characteristics.

However, more studies are necessary to reduce optical loss and improve color uniformity for applying such techniques to LED backlight units.

BRIEF SUMMARY

In one embodiment, a display device includes: a light source; a plurality of wavelength converting particles that convert a wavelength of light emitted from the light source; an accommodating part in which the wavelength converting particles are contained, the accommodating part including a curved surface; and a display panel configured to display images using the light changed by the wavelength converting particles.

In another embodiment, a display device includes: a display panel; a light guide plate under the display panel; at least one light source at a lateral surface of the light guide plate; and a wavelength converting member between the light guide plate and the light source, wherein the wavelength converting member includes: wavelength converting particles that convert a wavelength of light emitted from the light source; and an accommodating part in which the wavelength converting particles are contained, wherein the accommodating part includes at least one curved surface.

In further another embodiment, an optical member includes: a matrix; a plurality of wavelength converting particles in the matrix; and an accommodating part having a pipe shape and accommodating the matrix and the wavelength converting particles, the accommodating part including at least one curved surface.

The details of one or more embodiments are set forth in the accompanying drawings and the description below. Other features will be apparent from the description and drawings, and from the claims.

DETAILED DESCRIPTION

Figure 1:
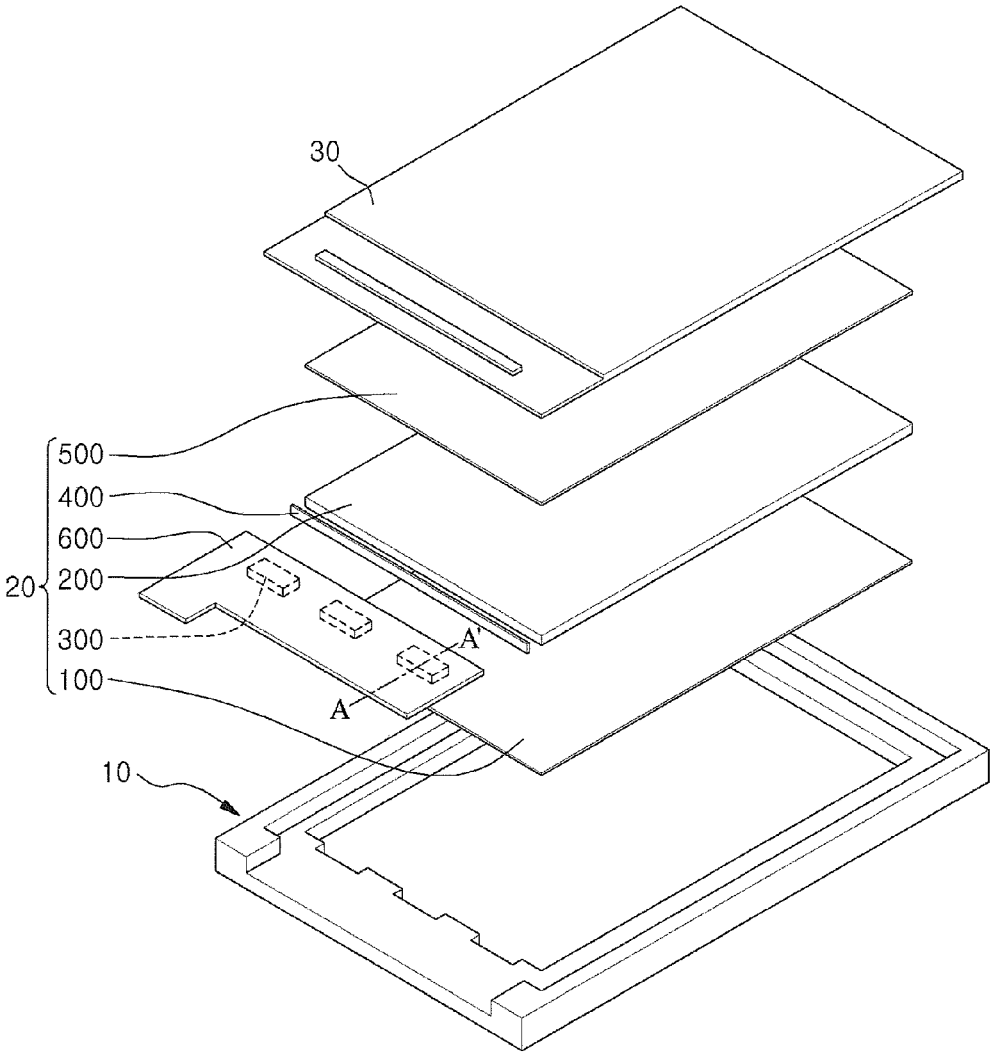
FIG. 1 is an exploded perspective view illustrating a liquid crystal display (LCD) according to a first embodiment.

In one embodiment, a display device includes: a light source; a plurality of wavelength converting particles that convert a wavelength of light emitted from the light source; an accommodating part in which the wavelength converting particles are contained, the accommodating part including a curved surface; and a display panel configured to display images using the light changed by the wavelength converting particles.

In another embodiment, a display device includes: a display panel; a light guide plate under the display panel; at least one light source at a lateral surface of the light guide plate; and a wavelength converting member between the light guide plate and the light source, wherein the wavelength converting member includes: wavelength converting particles that convert a wavelength of light emitted from the light source; and an accommodating part in which the wavelength converting particles are contained, wherein the accommodating part includes at least one curved surface.

In further another embodiment, an optical member includes: a matrix; a plurality of wavelength converting particles in the matrix; and an accommodating part having a pipe shape and accommodating the matrix and the wavelength converting particles, the accommodating part including at least one curved surface.

The display device includes a tube having a curved surface. Therefore, light may be incident on the wavelength converting particles through the curved surface, and/or light from the wavelength converting particles may pass through the curved surface.

As a result, light emitted from the light source and light changed by the wavelength converting particles can be uniformly incident on the display panel. That is, owing to the curved surface, light passed through the wavelength converting member can be uniformly incident on the light guide plate, and the light can be uniformly guided from the light guide plate to the display panel by refraction, scattering, and reflection.

Therefore, the display device of the embodiments can have improved brightness uniformity, and overall brightness of the display device can be improved.

Hereinafter, liquid crystal devices (LCDs) will be described in detail according to embodiments with reference to the accompanying drawings. In the descriptions of embodiments, it will be understood that when a substrate, a frame, a sheet, a layer (or film), or a pattern is referred to as being 'on/above/over/upper' another substrate, frame, sheet, layer (or film), or patterns, it can be directly on the other substrate, frame, sheet, layer (or film), or pattern, or one or more intervening substrates, frames, sheets, layers (or films), or patterns may also be present. Further, it will be understood that when a substrate, a frame, a sheet, a layer (or film), or a pattern is referred to as being 'under/below/lower' another substrate, frame, sheet, layer (or film), or patterns, it can be directly under the other substrate, frame, sheet, layer (or film), or pattern, or one or more intervening substrates, frames, sheets, layers (or films), or patterns may also be present. Therefore, meaning thereof should be judged according to the spirit of the present disclosure. Further, the reference about 'on' and 'under' each element will be made on the basis of drawings. Also, in the drawings, the sizes of elements may be exaggerated for clarity of illustration, and the size of each element does not entirely reflect an actual size.

Figure 2:
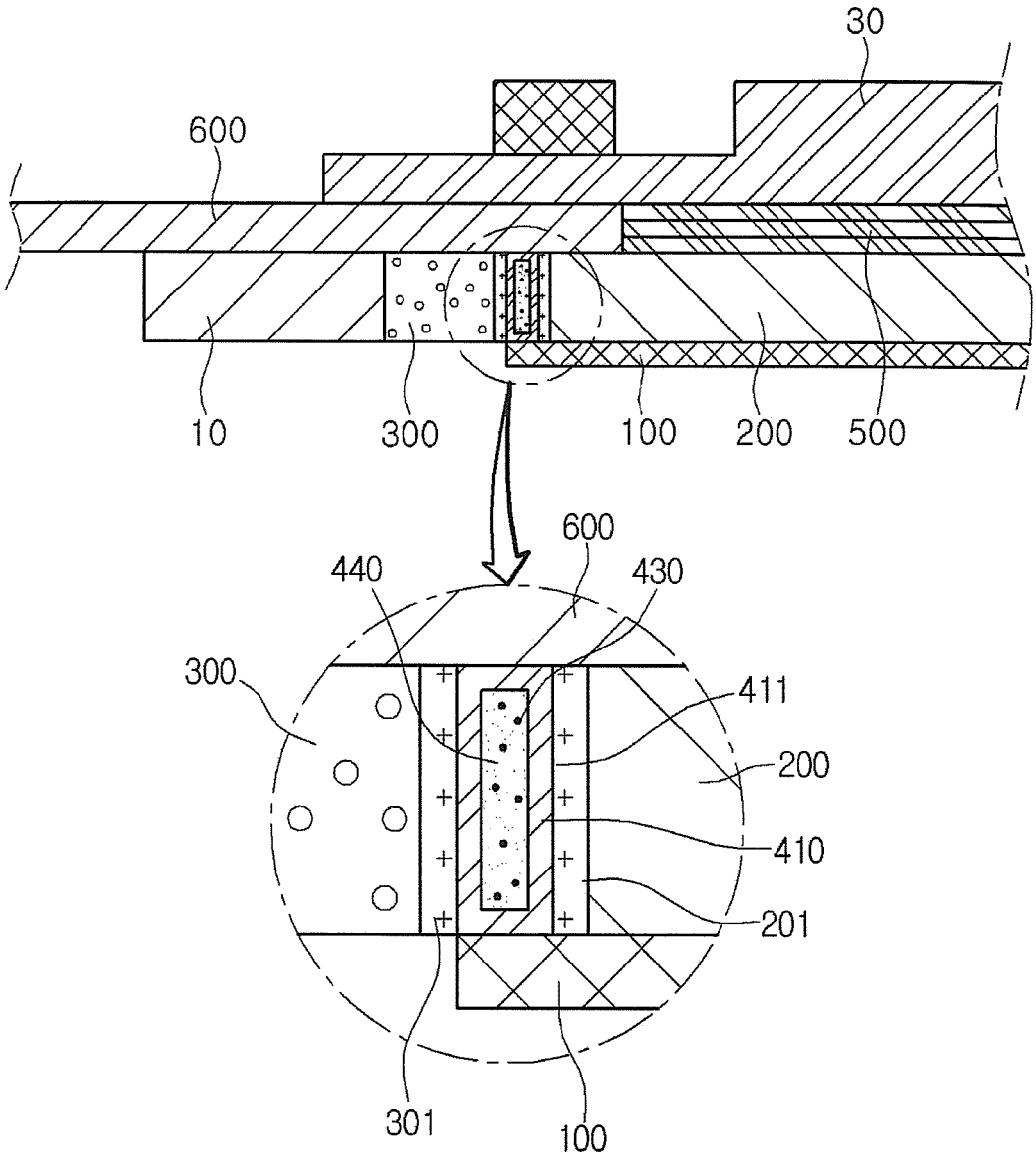
FIG. 2 is a sectional view taken along line A-A' of FIG. 1.
Figure 3:
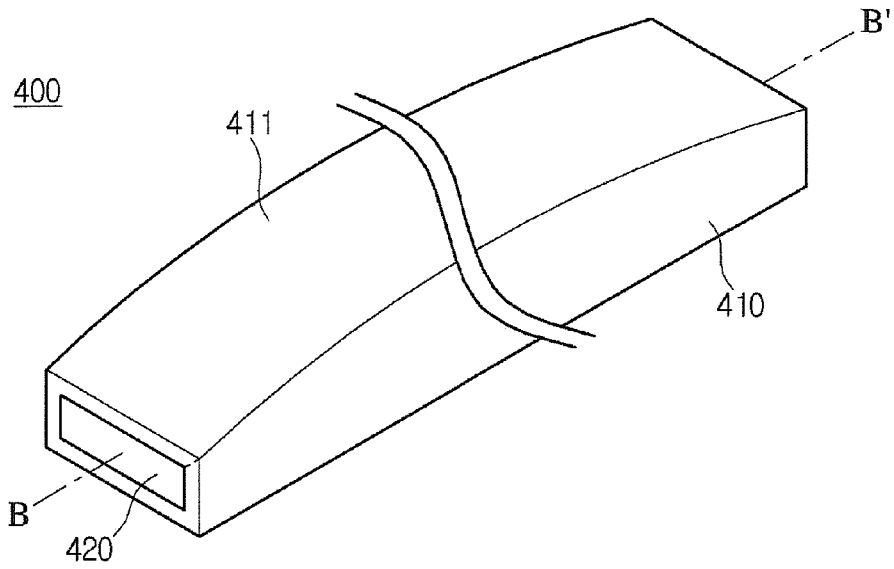
FIG. 3 is a perspective view illustrating a wavelength converting member according to the first embodiment.
Figure 4:
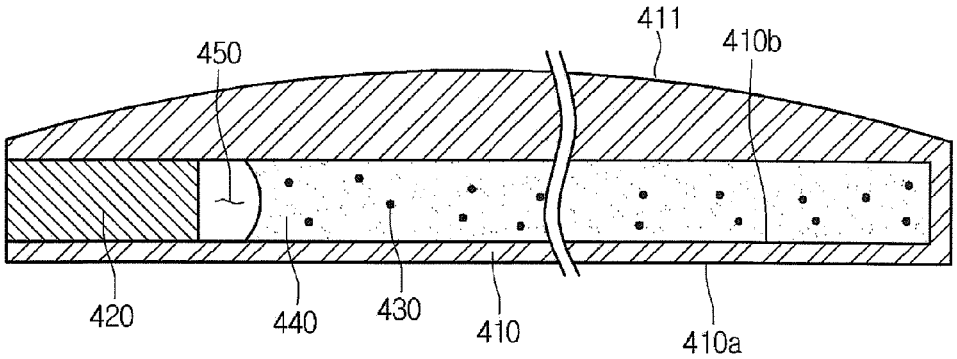
FIG. 4 is a sectional view taken along line B-B' FIG. 3.
Figure 5:
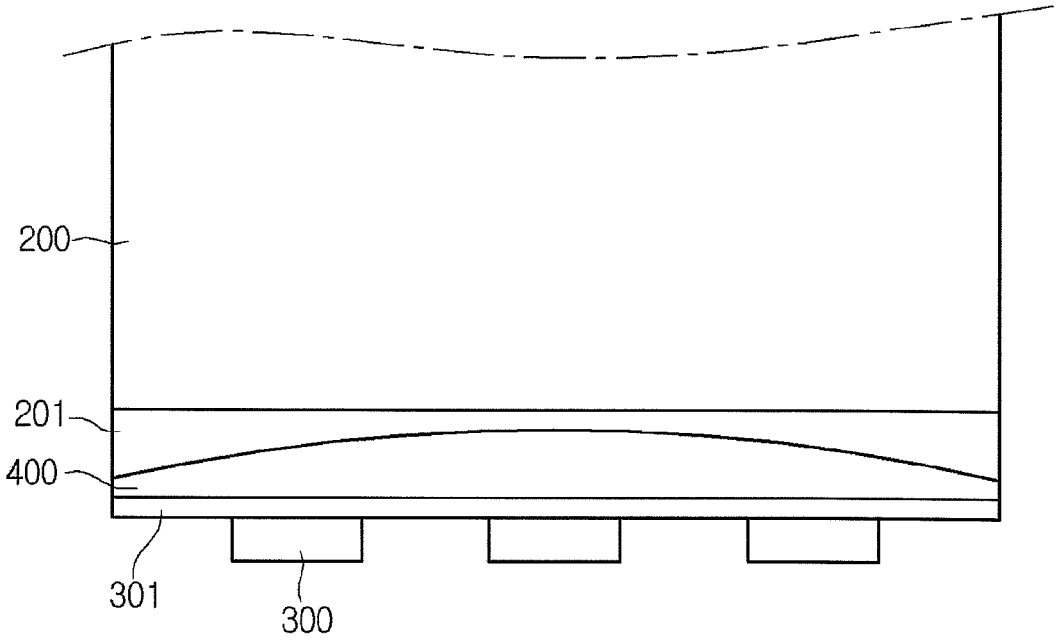
FIG. 5 is a plan view illustrating a light guide plate, the wavelength converting member, light emitting diodes (LEDs), a first adhesive layer, and a second adhesive layer according to the first embodiment.

FIG. 1 is an exploded perspective view illustrating an LCD according to a first embodiment. FIG. 2 is a sectional view taken along line A-A' of FIG. 1. FIG. 3 is a perspective view illustrating a wavelength converting member 400 according to the first embodiment. FIG. 4 is a sectional view taken along line B-B' FIG. 3. FIG. 5 is a plan view illustrating a light guide plate 200, the wavelength converting member 400, light emitting diodes (LEDs) 300, a first adhesive layer 201, and a second adhesive layer 301 according to the first embodiment.

Referring to FIGS. 1 to 5, the LCD includes a mold frame 10, a backlight assembly 20, and a liquid crystal panel 30.

The mold frame 10 accommodates the backlight assembly 20 and the liquid crystal panel 30. The mold frame 10 has a rectangular frame shape. The mold frame 10 may be formed of a material such as plastic or reinforced plastic.

A chassis may be disposed under the mold frame 10 to enclose the mold frame 10 and support the backlight assembly 20. The chassis may also be disposed along a lateral surface of the mold frame 10.

The backlight assembly 20 is disposed inside the mold frame 10 to emit light toward the liquid crystal panel 30. The backlight assembly 20 includes a reflection sheet 100, the light guide plate 200, the LEDs 300, the wavelength converting member 400, a plurality of optical sheets 500, and a flexible printed circuit board (FPCB) 600.

Light emitted from the LEDs 300 is reflected by the reflection sheet 100 in an upper direction.

The light guide plate 200 is disposed on the reflection sheet 100 to receive light emitted from the LEDs 300 and guide the light upward by reflection, refraction, and scattering.

The light guide plate 200 includes an entrance surface facing the LEDs 300. That is, one of lateral surfaces of the light guide plate 200 facing the LEDs 300 is the entrance surface.

The LEDs 300 are disposed along a lateral surface of the light guide plate 200. In more detail, the LEDs 300 are disposed along the entrance surface.

The LEDs 300 are light sources capable of emitting light. In more detail, the LEDs 300 emit light toward the wavelength converting member 400.

The LEDs 300 may be blue LEDs emitting blue light or UV LEDs emitting ultraviolet light. That is, the LEDs 300 may emit blue light having a wavelength in the range from about 430 nm to about 470 nm or an ultraviolet light having a wavelength in the range from about 300 nm to about 400 nm.

The LEDs 300 are disposed on the FPCB 600. The LEDs 300 may be disposed on the bottom side of the FPCB 600. The LEDs 300 operate in response to operating signals transmitted through the FPCB 600.

The wavelength converting member 400 is disposed between the LEDs 300 and the wavelength converting member 400. The wavelength converting member 400 is bonded to a lateral surface of the light guide plate 200. In detail, the wavelength converting member 400 is attached to the entrance surface of the light guide plate 200. In addition, the wavelength converting member 400 may be bonded to the wavelength converting member 400.

The wavelength converting member 400 receives light emitted from the LEDs 300 and changes the wavelength of the light. For example, blue light emitted from the LEDs 300 may be converted into green light and red light by the wavelength converting member 400. For example, the wavelength converting member 400 may convert a portion of blue light into green light having a wavelength in the range from about 520 nm to about 560 nm and the other portion of the blue light into red light having a wavelength in the range from about 630 nm to about 660 nm.

In addition, ultraviolet light emitted from the LEDs 300 may be converted into blue, green, and red light by the wavelength converting member 400. For example, the wavelength converting member 400 may convert a portion of ultraviolet light into blue light having a wavelength in the range from about 430 nm to about 470 nm, another portion of the ultraviolet light into green light having a wavelength in the range from about 520 nm to about 560 nm, and the other portion of the ultraviolet light into red light having a wavelength in the range from about 630 nm to about 660 nm.

Thus, white light can be obtained from light passed through the wavelength converting member 400 and light changed by the wavelength converting member 400. In other words, white light obtained by combining blue light, green light, and red light can be incident on the light guide plate 200. That is, the wavelength converting member 400 is an optical member for changing or improving characteristics of incident light.

As shown in FIGS. 3 and 4, the wavelength converting member 400 includes a tube 410, a sealing member 420, a plurality of wavelength converting particles 430, and a matrix 440.

The tube 410 accommodates the sealing member 420, the wavelength converting particles 430, and the matrix 440. The tube 410 is an accommodating part, that is, a container for accommodating the sealing member 420, the wavelength converting particles 430, and the matrix 440. The tube 410 extends in one direction.

The tube 410 may have a pipe shape. For example, the tube 410 may have a rectangular cross section which is perpendicular to the longitudinal direction of the tube 410. The tube 410 may have a width of about 0.6 mm and a height of about 0.2 mm. That is, the tube 410 may be a capillary tube.

The tube 410 includes a curved surface 411. In detail, at least one surface of the tube 410 is a curved surface 411. In more detail, the curved surface 411 is formed on at least portion of outer surfaces 410*a* of the tube 410. For example, a portion of surfaces of the tube 410 facing the light guide plate 200 may be partially or entirely curved.

As shown in FIG. 5, the curved surface 411 of the tube 410 may be convex toward the light guide plate 200. For example, a portion of surfaces of the tube 410 facing the light guide plate 200 may be entirely convex. The curved surface 411 of the tube 410 may have a radius of curvature in the range from about 4.3 cm to about 9 cm.

The curved surface 411 may be formed only on the outer surfaces 410*a* of the tube 410. That is, inner surfaces 410*b* of the tube 410 may be entirely flat.

The tube 410 is transparent. For example, the tube 410 may be formed of glass. That is, the tube 410 may be a glass capillary tube.

The sealing member 420 is disposed in the tube 410. The sealing member 420 is disposed in an end of the tube 410. The inside of the tube 410 is sealed with the sealing member 420. The sealing member 420 may include an epoxy resin.

The wavelength converting particles 430 are disposed in the tube 410. In detail, the wavelength converting particles 430 are uniformly dispersed in the matrix 440, and the matrix 440 is disposed in the tube 410.

The wavelength converting particles 430 change the wavelength of light emitted from the LEDs 300. The wavelength converting particles 430 receive light emitted from the LEDs 300 and change the wavelength of the light. For example, blue light emitted from the LEDs 300 may be converted into green light and red light by the wavelength converting particles 430. For example, the wavelength converting particles 430 may convert a portion of blue light into green light having a wavelength in the range from about 520 nm to about 560 nm and the other portion of the blue light into red light having a wavelength in the range from about 630 nm to about 660 nm.

In addition, ultraviolet light emitted from the LEDs 300 may be converted into blue, green, and red light by the wavelength converting particles 430. For example, the wavelength converting particles 430 may convert a portion of ultraviolet light into blue light having a wavelength in the range from about 430 nm to about 470 nm, another portion of the ultraviolet light into green light having a wavelength in the range from about 520 nm to about 560 nm, and the other portion of the ultraviolet light into red light having a wavelength in the range from about 630 nm to about 660 nm.

That is, if the LEDs 300 are blue LEDs emitting blue light, particles capable of converting blue light into green light and red light may be used as the wavelength converting particles 430. If the LEDs 300 are UV LEDs emitting ultraviolet light, particles capable of converting ultraviolet light into blue light, green light, and red light may be used as the wavelength converting particles 430.

The wavelength converting particles 430 may be quantum dots (QDs). The quantum dots may include core nanocrystals and shell nanocrystals enclosing the core nanocrystals. The quantum dots may further include organic ligands bonded to the shell nanocrystals. The quantum dots may further include organic coating layers enclosing the shell nanocrystals.

The shell nanocrystals may have a multilayer structure. The shell nanocrystals are formed on the surfaces of the core nanocrystals. In the quantum dots, the wavelength of light incident to the core nanocrystals may be increased by the shell nanocrystals for improving optical efficiency.

The quantum dots may include at least one of a group II compound semiconductor, a group III compound semiconductor, and a group V compound semiconductor. In detail, the core nanocrystals may include Cdse, InGaP, CdTe, CdS, ZnSe, ZnTe, ZnS, HgTe, or HgS. The shell nanocrystals may include CuZnS, CdSe, CdTe, CdS, ZnSe, ZnTe, ZnS, HgTe, or HgS. The quantum dots may have a diameter in the range from 1 nm to 10 nm.

The wavelength of light from the quantum dots can be adjusted by varying the size of the quantum dots or the molar ratio of a molecular cluster compound and a nanoparticle precursor when forming the quantum dots. The organic ligands may include pyridine, mercapto alcohol, thiol, phosphine, and phosphine oxide. After the quantum dots are formed, the quantum dots may be unstable. Thus, the organic ligands are used to stabilize the quantum dots. After the quantum dots are formed, dangling bonds are present around the quantum dots, which may make the quantum dots unstable. Non-bonded ends of the organic ligands are bonded to the dangling bonds, and thus the quantum dots can be stabilized.

If the size of the quantum dots is smaller than the Bohr radius of excitons formed by electrons and holes excited by, for example, light or electricity, quantum confinement effect occurs. Then, the quantum dots have intermittent energy levels, and the energy gap of the quantum dots is varied. In addition, charges are confined in the quantum dots so that high light emitting efficiency can be obtained.

Unlike general fluorescent dyes, the fluorescence wavelength of the quantum dots is varied according to the size of the quantum dots. That is, as the size of the quantum dots is decreased, the wavelength of light from the quantum dots is shortened. That is, light having a desired wavelength such as visible light can be obtained by adjusting the size of the quantum dots. The extinction coefficient of the quantum dots is 100 to 1000 times that of general dyes, and the quantum yield of the quantum dots is very high. Thus, intensive fluorescent light can be obtained using the quantum dots.

The quantum dots may be prepared by a wet chemical method. In the wet chemical method, a precursor material is placed in an organic solvent to grow particles. In this way, the quantum dots can be synthesized by the wet chemical method.

The matrix 440 encloses the wavelength converting particles 430. That is, the wavelength converting particles 430 are uniformly dispersed in the matrix 440. The matrix 440 may be formed of a polymer. The matrix 440 is transparent. That is, the matrix 440 may be formed of a transparent polymer.

The matrix 440 is disposed in the tube 410. That is, the matrix 440 is entirely disposed in the tube 410. The matrix 440 may be in contact with the inner surface of the tube 410.

An air layer 450 is formed between the sealing member 420 and the matrix 440. The air layer 450 may be a nitrogen layer. The air layer 450 functions as a buffering layer between the sealing member 420 and the matrix 440.

Referring to FIGS. 2 and 5, the wavelength converting member 400 is bonded to the light guide plate 200. The first adhesive layer 201 is disposed between the wavelength converting member 400 and the light guide plate 200. That is, the wavelength converting member 400 is bonded to a lateral surface of the light guide plate 200 through the first adhesive layer 201.

The wavelength converting member 400 is brought into contact with the first adhesive layer 201. In detail, the tube 410 is brought into contact with the first adhesive layer 201. In more detail, the curved surface 411 of the tube 410 is brought into contact with the first adhesive layer 201. In more detail, the first adhesive layer 201 may be entirely in contact with the curved surface 411 of the tube 410.

The first adhesive layer 201 has a curved surface corresponding to the curved surface 411 of the tube 410. That is, the curved surface of the first adhesive layer 201 has a shape corresponding to the shape of the curved surface 411 of the tube 410.

The index of refraction of the first adhesive layer 201 may be higher than the index of refraction of the tube 410. For example, the index of refraction of the tube 410 may be in the range from about 1.2 to about 1.4, and the index of refraction of the first adhesive layer 201 may be in the range from about 1.3 to about 1.7.

The first adhesive layer 201 is transparent. The first adhesive layer 201 may be formed of a material such as an epoxy resin or an acryl resin.

The wavelength converting member 400 is bonded to the LEDs 300. The second adhesive layer 301 is disposed between the wavelength converting member 400 and the LEDs 300. The wavelength converting member 400 may be bonded to light exit surfaces of the LEDs 300 through the second adhesive layer 301.

The wavelength converting member 400 is brought into contact with the second adhesive layer 301. In detail, the tube 410 is brought into contact with the second adhesive layer 301. The second adhesive layer 301 is transparent. The second adhesive layer 301 may be formed of a material such as an epoxy resin or an acryl resin.

Figure 6:
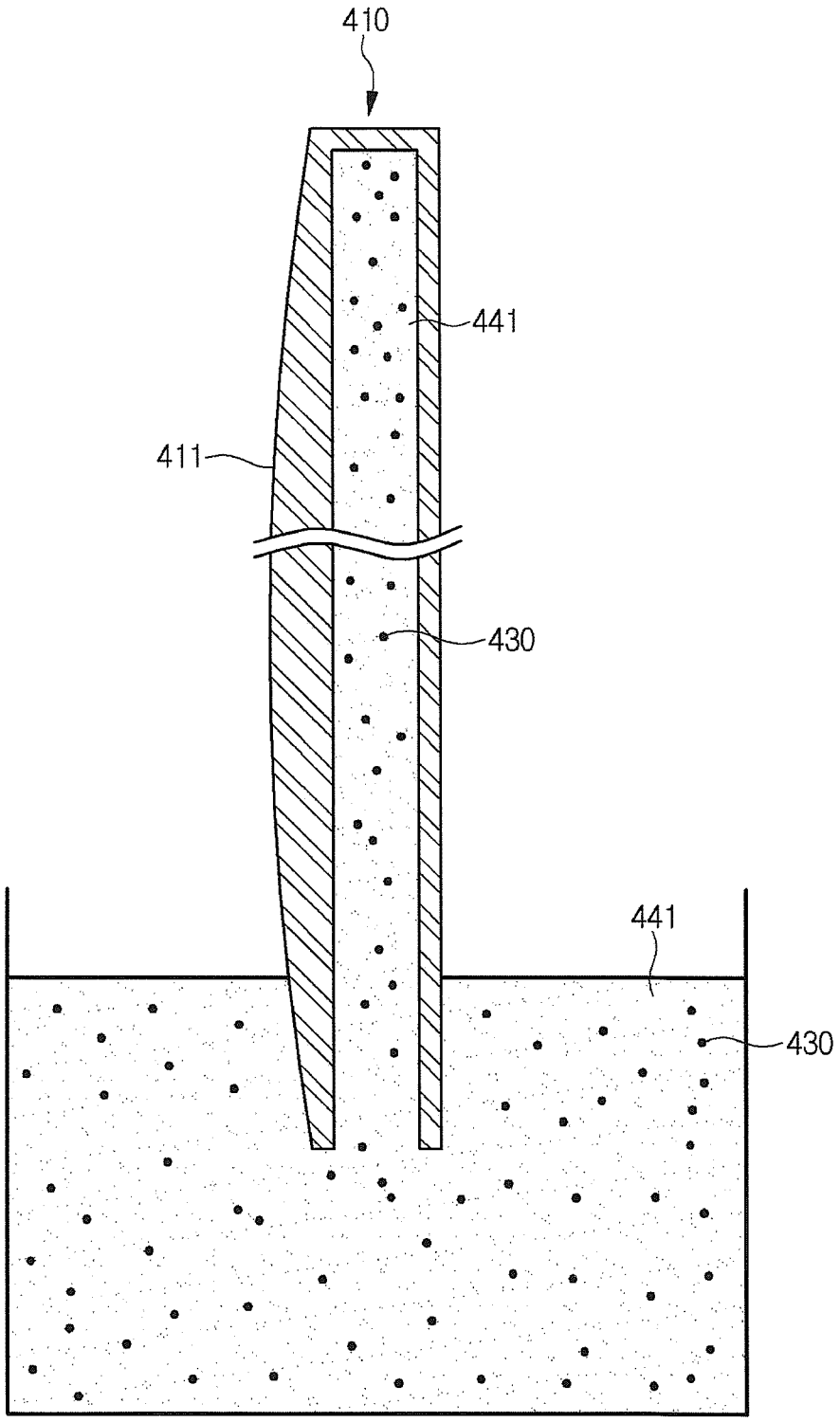
FIGS. 6 to 8 are views for explaining a process of manufacturing the wavelength converting member.
Figure 7:
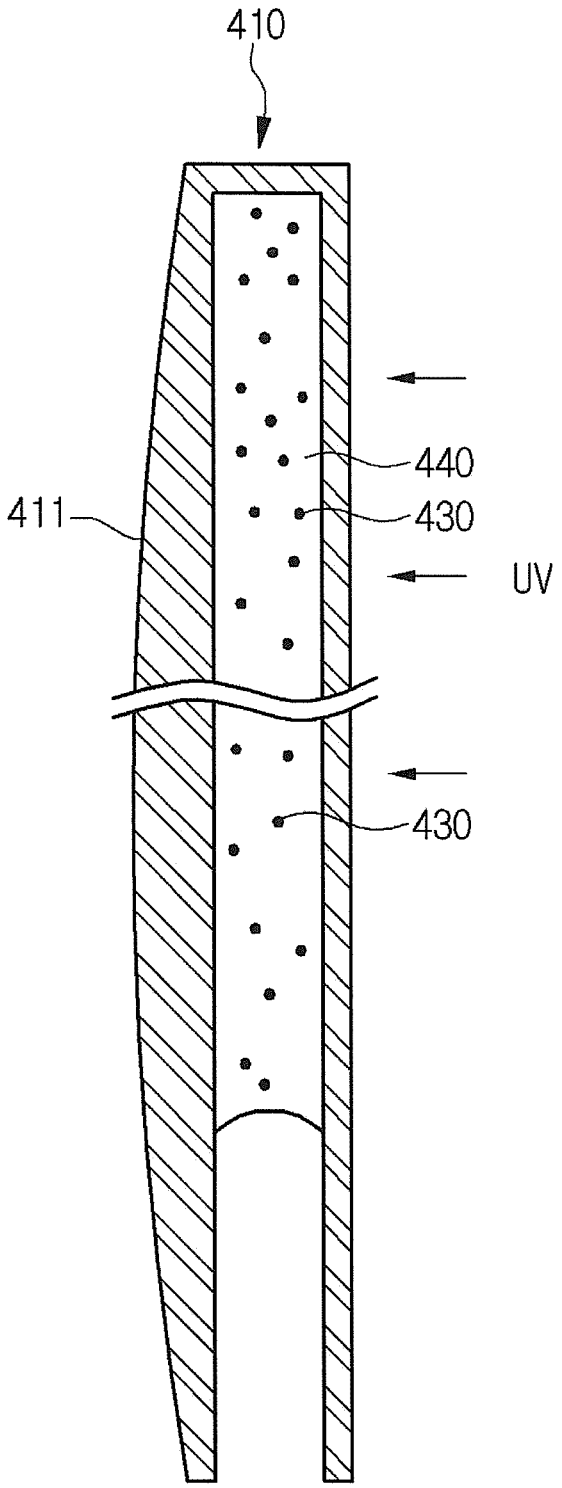
Figure 8:
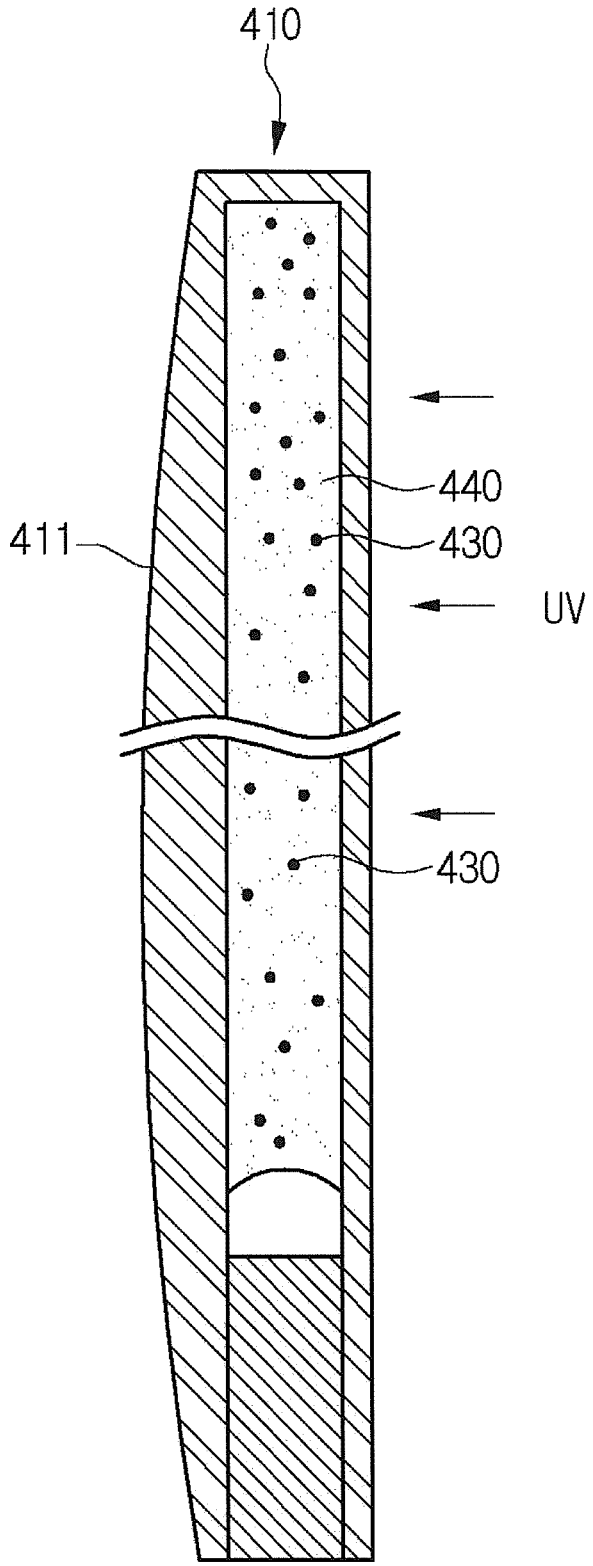

FIGS. 6 to 8 are views for explaining a process of manufacturing the wavelength converting member 400. The wavelength converting member 400 may be formed as follows.

Referring to FIG. 6, wavelength converting particles 430 are uniformly dispersed in a resin composition 441. The resin composition 441 is transparent. The resin composition 441 may be photocurable.

The inside of a tube 410 is decompressed, and an inlet of the tube 410 is immerged in the resin composition 441. Then, the surrounding pressure is increased. Thus, the resin composition 441 in which the wavelength converting particles 430 are dispersed is moved into the tube 410.

Referring to FIG. 7, the resin composition 441 introduced into the tube 410 is partially removed to make the inlet of the tube 410 empty. Thereafter, the resin composition 441 disposed in the tube 410 is hardened by, for example, ultraviolet rays, so as to form a matrix 440.

Referring to FIG. 8, the inlet of the tube 410 is filled with an epoxy resin composition. Then, the epoxy resin composition is hardened to form a sealing member 420. The sealing member 420 is formed in a nitrogen atmosphere, and thus an air layer including nitrogen may be formed between the sealing member 420 and the matrix 440.

The optical sheets 500 are disposed on the light guide plate 200. The optical sheets 500 are provided to improve characteristics of light passing through the optical sheets 500.

The FPCB 600 is electrically connected to the LEDs 300. For example, the LEDs 300 may be disposed on the FPCB 600. The FPCB 600 is disposed in the mold frame 10. The FPCB 600 is disposed on the light guide plate 200 in the mold frame 10.

The mold frame 10 and the backlight assembly 20 constitute a backlight unit. That is, the backlight unit includes the mold frame 10 and the backlight assembly 20.

The liquid crystal panel 30 is disposed in the mold frame 10 on the optical sheets 500.

The liquid crystal panel 30 displays images by adjusting the intensity of light passing through the liquid crystal panel 30. That is, the liquid crystal panel 30 is a display panel for displaying images. The liquid crystal panel 30 includes a thin film transistor (TFT) substrate, a color filter substrate, a liquid crystal layer disposed between the TFT substrate and the color filter substrate, and a polarizing filter.

As described above, light emitted from the LEDs 300 and/or light changed by the wavelength converting particles 430 may be dispersed by the curved surface 411 of the tube 410. That is, owing to the curved surface 411 of the tube 410, light can be uniformly incident on the light guide plate 200.

In other words, since the index of refraction of the first adhesive layer 201 is higher than the index of refraction of the tube 410 and the curved surface 411 of the tube 410 is convex, light is diverged after passing through the tube 410. Therefore, the light can be uniformly incident on the light guide plate 200.

In addition, since the divergence angle of the wavelength converting member 400 is large owing to the curved surface 411 of the tube 410, color uniformity can be improved.

The LCD of the current embodiment can display images by using uniform light, and thus the brightness uniformity of the LCD can be improved. In addition, the optical efficiency of the LCD of the embodiment can be improved without brightness non-uniformity such as hot spots.

Particularly, in the LCD of the embodiment, Fresnel loss can be reduced owing to the curved surface 411 of the tube 410.

Therefore, the brightness of the LCD of the embodiment can be improved.

In addition, since the first adhesive layer 201 is bonded to the curved surface 411 of the tube 410, a bonding area between the first adhesive layer 201 and the tube 410 is large.

Therefore, the wavelength converting member 400 can be thinly bonded to the light guide plate 200. Therefore, the LCD of the embodiment can be more durable.

Figure 9:
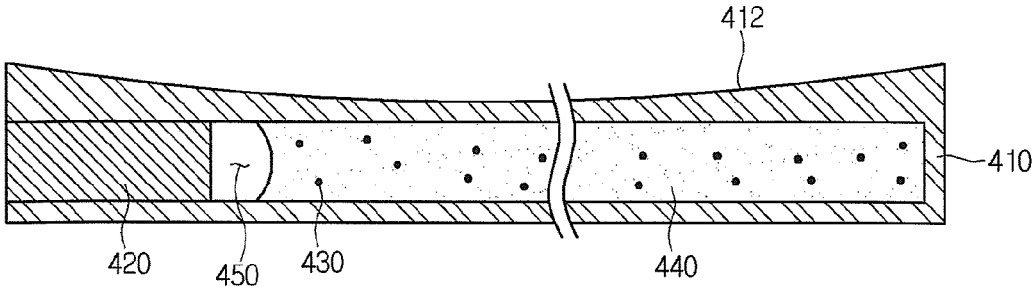
FIG. 9 is a sectional view illustrating a wavelength converting member according to a second embodiment.
Figure 10:
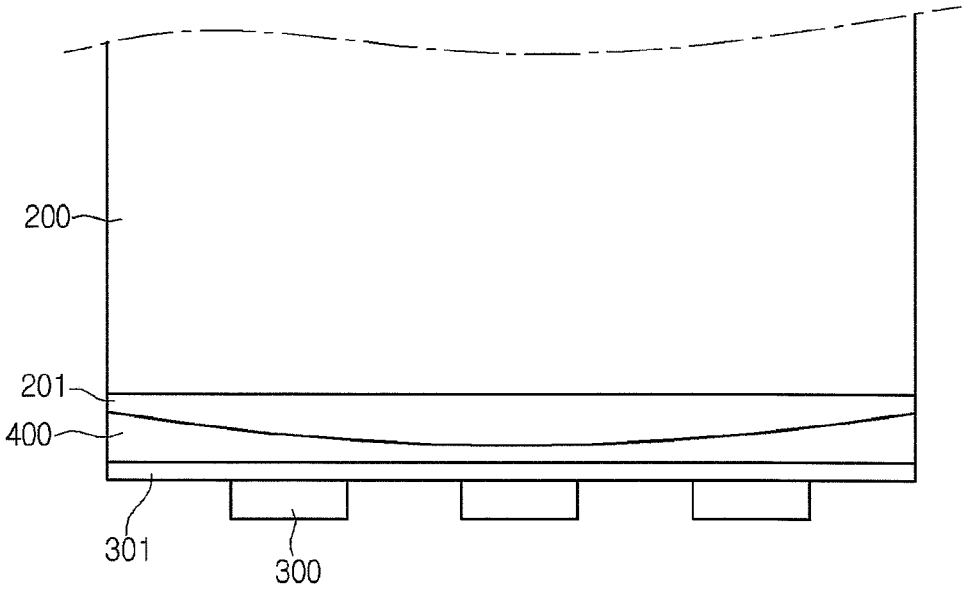
FIG. 10 is a plan view illustrating a light guide plate, the wavelength converting member, LEDs, a first adhesive layer, and a second adhesive layer according to the second embodiment.

FIG. 9 is a sectional view illustrating a wavelength converting member according to a second embodiment. FIG. 10 is a plan view illustrating a light guide plate 200, the wavelength converting member 400, LEDs 300, a first adhesive layer 201, and a second adhesive layer 301 according to the second embodiment. The description of the LCD of the previous embodiment is also applied to an LCD of the current embodiment except for the wavelength converting member 400 and the first adhesive layer 201. That is, the description of the previous embodiment may be incorporated in the following description of the current embodiment except for different parts.

As shown in FIG. 9, a tube 410 includes a concave surface 412. The concave surface 412 faces the light guide plate 200. The concave surface 412 faces a lateral surface of the light guide plate 200. That is, the surface 412 of the tube 410 is concave toward the light guide plate 200.

The concave surface 412 may be formed entirely on a surface of the tube 410 facing the light guide plate 200. The concave surface 412 may have a radius of curvature in the range from about 4.3 cm to about 9 cm.

As shown in FIG. 10, the first adhesive layer 201 is disposed between the tube 410 and the light guide plate 200. The first adhesive layer 201 has a convex surface corresponding to the concave surface 412 of the tube 410.

The index of refraction of the first adhesive layer 201 is lower than the index of refraction of the tube 410. For example, the index of refraction of the tube 410 may be in the range from about 1.4 to about 1.5, and the index of refraction of the first adhesive layer 201 may be in the range from about 1.3 to about 1.4.

The tube 410 is concave, and the index of refraction of the first adhesive layer 201 is lower than the index of refraction of the tube 410. Therefore, light passed through the wavelength converting member 400 and light changed by the wavelength converting member 400 are diverged and incident on the light guide plate 200.

Therefore, the brightness uniformity of the LCD of the embodiment can be improved. In addition, the brightness of the LCD of the embodiment can be improved.

Figure 11:
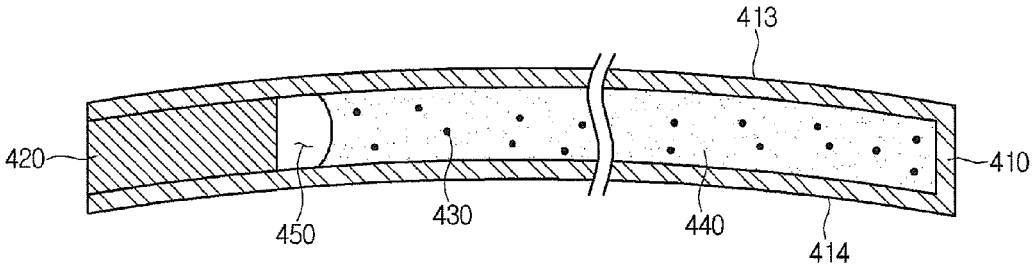
FIG. 11 is a sectional view illustrating a wavelength converting member according to a third embodiment.
Figure 12:
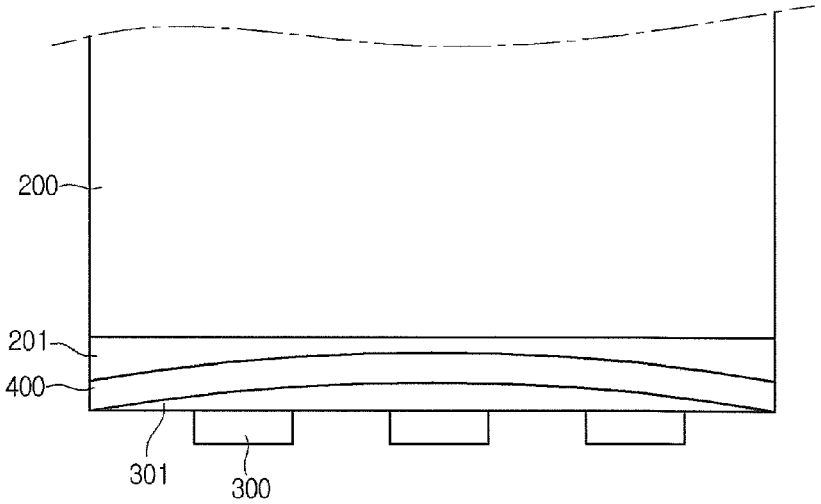
FIG. 12 is a plan view illustrating a light guide plate, the wavelength converting member, LEDs, a first adhesive layer, and a second adhesive layer according to the third embodiment.

FIG. 11 is a sectional view illustrating a wavelength converting member according to a third embodiment. FIG. 12 is a plan view illustrating a light guide plate 200, the wavelength converting member 400, LEDs 300, a first adhesive layer 201, and a second adhesive layer 301 according to the third embodiment. The description of the LCD of the previous embodiment is also applied to an LCD of the current embodiment except for the wavelength converting member 400, the first adhesive layer 201, and the second adhesive layer 301. That is, the description of the previous embodiment may be incorporated in the following description of the current embodiment except for different parts.

Referring to FIGS. 11 and 12, a tube 410 may have a bent shape. That is, the tube 410 may have a first curved surface 413 which is convex and a second curved surface 414 which is concave. In addition, the tube 410 may have curved inner surfaces. The tube 410 may be prepared by heating a straight tube and mechanically bending the heated tube.

The first curved surface 413 may face the light guide plate 200, and the second curved surface 414 may face the LEDs 300. The first adhesive layer 201 may be brought in contact with the first curved surface 413, and the second adhesive layer 301 may be brought into contact with the second curved surface 414.

Otherwise, the first curved surface 413 may face the LEDs 300, and the second curved surface 414 may face the light guide plate 200. In this case, the second adhesive layer 301 may be brought in contact with the first curved surface 413, and the first adhesive layer 201 may be brought into contact with the second curved surface 414.

The index of refraction of the first adhesive layer 201 may be higher than the index of refraction of the tube 410. The index of refraction of the second adhesive layer 301 may be lower than the index of refraction of the tube 410. Light transmitted through the tube 410 and light changed by the tube 410 can be efficiently distributed by the first curved surface 413 and the second curved surface 414.

Therefore, the brightness and brightness uniformity of the LCD of the embodiment can be improved.

Figure 13:
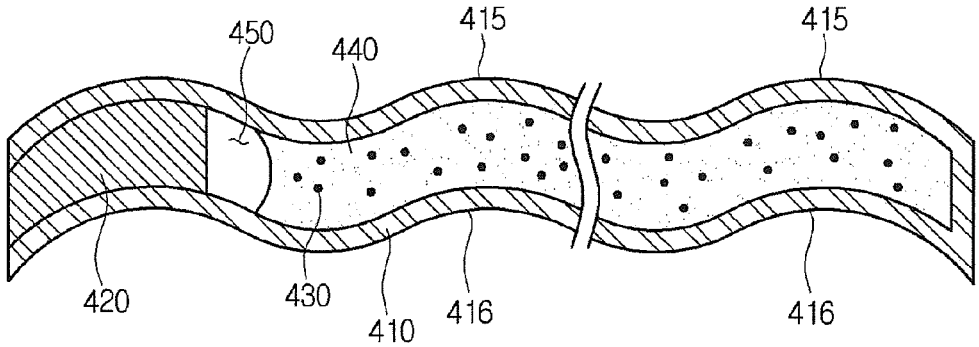
FIG. 13 is a sectional view illustrating a wavelength converting member according to a fourth embodiment.
Figure 14:
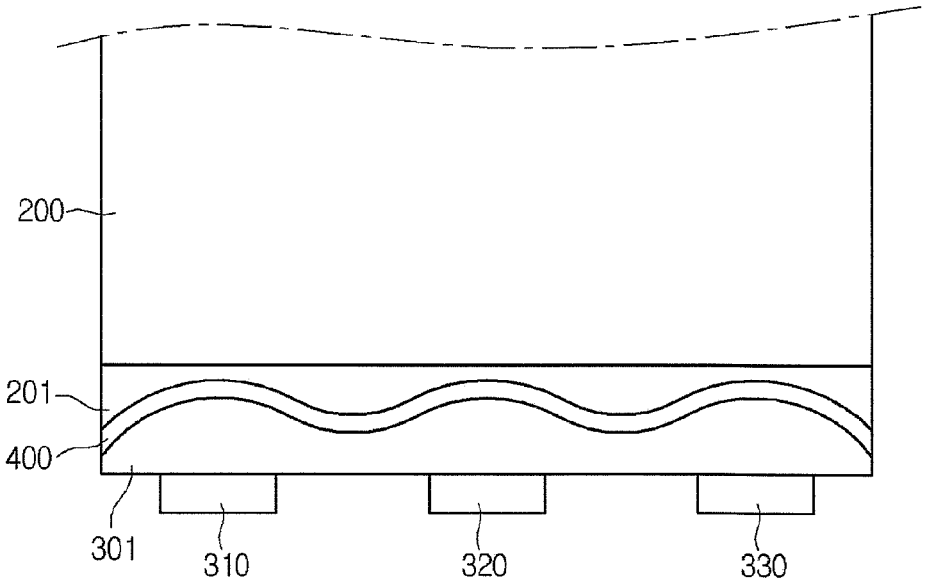
FIG. 14 is a plan view illustrating a light guide plate, the wavelength converting member, LEDs, a first adhesive layer, and a second adhesive layer according to the fourth embodiment.

FIG. 13 is a sectional view illustrating a wavelength converting member according to a fourth embodiment. FIG. 14 is a plan view illustrating a light guide plate 200, the wavelength converting member 400, LEDs 310, 320, and 330, a first adhesive layer 201, and a second adhesive layer 301 according to the fourth embodiment. The description of the LCD of the previous embodiment is also applied to an LCD of the current embodiment except for a tube 410. That is, the description of the previous embodiment may be incorporated in the following description of the current embodiment except for different parts.

Referring to FIGS. 13 and 14, the wavelength converting member 400 may have a bent shape. For example, the wavelength converting member 400 may be bent at least twice. That is, the tube 410 may be bent two or more times. The tube 410 includes a plurality of first curved surfaces 415 that are convex and a plurality of second curved surfaces 416 that are concave. The first curved surfaces 415 correspond to the second curved surfaces 416.

The LEDs 310, 320, and 330 are disposed at the second curved surfaces 416, respectively. That is, the LEDs 310, 320, and 330 correspond to the second curved surfaces 416, respectively. In the current embodiment, three LEDs 310, 320, and 330 are shown. However, the number of the LEDs 310, 320, and 330 is not limited to three.

In the LCD of the current embodiment, light emitted from the LEDs 310, 320, and 330 can be efficiently distributed.

Therefore, the brightness and brightness uniformity of the LCD of the embodiment can be improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a light source;

a plurality of wavelength converting particles that convert a wavelength of light emitted from the light source;

an accommodating part in which the wavelength converting particles are contained, the accommodating part comprising a curved surface;

a display panel configured to display images using the light changed by the wavelength converting particles;

a light guide plate to receive the light changed by the wavelength converting particles and guide the light to the display panel; and an adhesive layer disposed between the light guide plate and the accommodating part, wherein the curved surface faces a lateral surface of the light guide plate, wherein the adhesive layer has an index of refraction higher than an index of refraction of the accommodating part, and wherein the curved surface is convex toward the light guide plate.

2. The display device according to claim 1, wherein the accommodating part has a pipe shape.

3. A display device comprising:

a light source;

a plurality of wavelength converting particles that convert a wavelength of light emitted from the light source;

an accommodating part in which the wavelength converting articles are contained, the accommodating part comprising a curved surface;

a display panel configured to display images using the light changed by the wavelength converting particles;

a light guide plate to receive the light changed by the wavelength converting particles and guide the light to the display panel; and an adhesive layer disposed between the light guide plate and the accommodating part, wherein the curved surface faces a lateral surface of the light guide plate, wherein the adhesive layer has an index of refraction lower that an index of refraction of the accommodating part, and wherein the curved surface is concave toward the light guide plate.

4. A display device comprising:

a display panel;

a light guide plate disposed under the display panel;

at least one light source at a lateral surface of the light guide plate; and a wavelength converting member between the light guide plate and the light source, wherein the wavelength converting member comprises:

wavelength converting particles that convert a wavelength of light emitted from the light source;

an accommodating part in which the wavelength converting particles are contained;

a first adhesive layer between the light guide plate and the accommodating part; and a second adhesive layer between the light source and the accommodating part, wherein the accommodating part comprises at least one curved surface, and wherein the first adhesive layer has an index of refraction higher than an index of refraction of the accommodating part, and the second adhesive layer has an index of refraction lower than an index of refraction of the accommodating part.

5. The display device according to claim 4, wherein the curved surface corresponds to the light source.

6. The display device according to claim 4, wherein the light source comprises a plurality of light emitting diodes, wherein the accommodating part comprises:

curved concave surfaces corresponding to the light emitting diodes, respectively; and curved convex surfaces corresponding to the concave surfaces and facing the lateral surface of the light guide plate.

* * * * *